US009995015B2

(12) United States Patent
Beckmann et al.

(10) Patent No.: US 9,995,015 B2
(45) Date of Patent: Jun. 12, 2018

(54) SIDE WALL FOR A MOVABLE PART OF AN EXCAVATOR BUCKET

(71) Applicant: Caterpillar Global Mining LLC, Oak Creek, WI (US)

(72) Inventors: Detlef Beckmann, Lünen (DE); Elvis Tormen, Stadtlohn (DE)

(73) Assignee: Caterpillar Global Mining LLC, Tuscon, AZ (US)

( * ) Notice: Subject to any disclaimer, the term of this patent is extended or adjusted under 35 U.S.C. 154(b) by 0 days. days.

(21) Appl. No.: 15/116,083

(22) PCT Filed: Feb. 10, 2015

(86) PCT No.: PCT/US2015/015173
§ 371 (c)(1),
(2) Date: Aug. 2, 2016

(87) PCT Pub. No.: WO2015/123189
PCT Pub. Date: Aug. 20, 2015

(65) Prior Publication Data

US 2017/0167108 A1 Jun. 15, 2017

(30) Foreign Application Priority Data

Feb. 11, 2014 (EP) ..... 14154733

(51) Int. Cl.
*E02F 3/40* (2006.01)
*E02F 3/30* (2006.01)
*E02F 9/22* (2006.01)

(52) U.S. Cl.
CPC ..... *E02F 3/40* (2013.01); *E02F 3/308* (2013.01); *E02F 9/2271* (2013.01)

(58) Field of Classification Search
CPC ..... B66C 3/02; E02F 3/60; E02F 3/40; E02F 3/407; E02F 3/4075; E02F 3/425;
(Continued)

(56) References Cited

U.S. PATENT DOCUMENTS 1,437,392 A * 12/1922 Botten ..... B66C 3/02 37/184
1,864,793 A * 6/1932 Botten ..... B66C 3/02 37/184

(Continued)

FOREIGN PATENT DOCUMENTS

DE 202010006153 U1 7/2010
FR 2939160 A1 6/2010
WO WO 2007/098542 A1 9/2007

OTHER PUBLICATIONS

International Search Report dated Apr. 16, 2015, issued in PCT/US2015/015173 (1 page).

(Continued)

*Primary Examiner* — Robert E Pezzuto

(57) ABSTRACT

A side wall of a movable part of an excavator bucket is disclosed. The side wall may have a sheet metal base. The sheet metal base may have an attachment portion for attaching the side wall to a rear wall of the excavator bucket. The sheet metal base may also have a cranked portion extending from the attachment portion. Further, the sheet metal base may have an extension portion extending from the cranked portion to a distal end of the sheet metal base.

20 Claims, 4 Drawing Sheets

(58) Field of Classification Search
CPC . E02F 3/401; E02F 3/404; E02F 3/304; E02F 3/308; E02F 9/2271
USPC ..... 37/184, 398, 444, 446; 414/697, 722, 414/726
See application file for complete search history.

(56) References Cited

U.S. PATENT DOCUMENTS

| | | | | | |
|---|---|---|---|---|---|
| 1,914,104 | A | * | 6/1933 | Black | E02F 3/40 37/444 |
| 1,938,163 | A | | 12/1933 | Yaun | |
| 2,336,729 | A | | 12/1943 | Harris et al. | |
| 3,854,608 | A | * | 12/1974 | Arnold | E02F 3/404 37/406 |
| 4,103,791 | A | | 8/1978 | Ullmann | |
| 4,633,601 | A | | 1/1987 | Fleck et al. | |
| 5,063,694 | A | * | 11/1991 | McCreary, Jr. | E02F 3/40 37/443 |
| 5,743,030 | A | * | 4/1998 | Sirr | B07B 1/005 209/421 |
| 2012/0279095 | A1 | | 11/2012 | Feld et al. | |
| 2013/0195594 | A1 | | 8/2013 | Knuth | |

OTHER PUBLICATIONS

European Search Report dated Jun. 23, 2014, issued in EP 14154733 (2 pages).

* cited by examiner

SIDE WALL FOR A MOVABLE PART OF AN EXCAVATOR BUCKET

CLAIM FOR PRIORITY

This application is a U.S. National Phase entry under 35 U.S.C. § 371 from PCT International Application No. PCT/US2015/015173, filed Feb. 10, 2015, which claims benefit of priority of European Patent Application No. 14154733.1, filed Feb. 11, 2014, all of which are incorporated herein by reference.

TECHNICAL FIELD

The present disclosure generally relates to bucket assemblies for machines, in particular, a side wall for a movable part of an excavator bucket.

BACKGROUND

A machine such as a hydraulic excavator may be equipped with a bucket assembly to perform various operations at a work site. Such machines often include implements (e.g., hydraulic shovels or buckets) powered by hydraulic pressure. Operations carried out by such machines may include, for example, penetrating material in the ground or in a pile, scooping material, moving material, and depositing the material in a desired location. During operation, various components of the bucket assembly may be worn and may eventually be damaged. This may require replacing one or more parts of the bucket assembly, which may result in undesired downtimes and an increase in the operating costs of associated machines.

The disclosed systems and methods are directed at least in part to improving known bucket assemblies.

SUMMARY OF THE DISCLOSURE

In one aspect, the present disclosure relates to a side wall of a movable part of an excavator bucket. The side wall comprises a sheet metal base including an attachment portion for attaching the side wall to a rear wall of the excavator bucket. The sheet metal base includes a cranked portion extending from the attachment portion, and an extension portion extending from the cranked portion to the distal end of the sheet metal base.

In another aspect, the present disclosure relates to a movable part of an excavator bucket. The movable part comprises a first side wall and a second side wall, and a bottom connected to the first side wall and the second side wall. Each of the first side wall and the second side wall comprises a sheet metal base including an attachment portion for attaching the side wall to a rear wall of the excavator bucket. The sheet metal base includes a cranked portion extending from the attachment portion, and an extension portion extending from the cranked portion to the distal end of the sheet metal base.

In yet another aspect, the present disclosure relates to a machine comprising an excavator bucket including a rear wall and a movable part, and a hydraulic actuator configured to pivot the movable part with respect to the rear wall. The movable part comprises a first side wall and a second side wall, and a bottom connected to the first side wall and the second side wall. Each of the first side wall and the second side wall comprises a sheet metal base including an attachment portion for attaching the side wall to a rear wall of the excavator bucket. The sheet metal base includes a cranked portion extending from the attachment portion, and an extension portion extending from the cranked portion to the distal end of the sheet metal base.

In a further aspect of the present disclosure, a method of forming a side wall of a movable part of an excavator bucket comprises providing a flat sheet metal base. The method further comprises bending the flat sheet metal base to form an attachment portion for attaching the side wall to a rear wall of the excavator bucket, a cranked portion extending from the attachment portion, and an extension portion extending from the cranked portion to the distal end of the sheet metal base.

Other features and aspects of the present disclosure will be apparent from the following description and the accompanying drawings.

DETAILED DESCRIPTION

The following is a detailed description of exemplary embodiments of the present disclosure. The exemplary embodiments described herein are intended to teach the principles of the present disclosure, enabling those of ordinary skill in the art to implement and use the present disclosure in many different environments and for many different applications. Therefore, the exemplary embodiments are not intended to be, and should not be considered as a limiting description of the scope of protection. Rather, the scope of protection shall be defined by the appended claims.

The present disclosure may be based in part on the realization that, when a front part of an excavator bucket includes side walls which are formed of several parts connected to each other by welding, a weld between such parts may disturb a distribution of forces between the same. Further, the quality of the weld may vary. Accordingly, cracks in the region of such welds are the most common causes for damaging of the front part of such an excavator bucket. If this happens, the excavator has to be temporarily taken out of service over an extended period of time, and expensive repairs are necessary. According to the present disclosure, a side wall of a front part of an excavator bucket is formed with a reduced number of parts, thereby eliminating one or more welds.

Further, the present disclosure may be based on the realization that, in case a cast iron lever is used for attaching the side walls of a front part of an excavator bucket to a rear wall of the same, the cast iron lever may break due to the huge load when the bucket is opened. In particular, during opening of the bucket, the associated hydraulic actuators must work against the weight of the front part, and the resulting force is transmitted via the upper part of the cast iron lever. Due to wear of material and imperfections during the casting, the lever may break. Accordingly, the present disclosure does not use such a cast iron lever for attaching the front part to the rear wall of the excavator bucket.

In addition, the present disclosure may be based on the realization that, when the front part is attached to the rear wall of the excavator bucket, the side walls of the front part must extend outward from the rear wall to reduce the resistance during digging operations. Accordingly, the side walls must include a cranked portion to allow an extension of the side walls outward from the point of attachment to the rear wall of the excavator bucket. According to the present disclosure, this cranked portion is formed by bending a sheet metal base to result in the desired cranked portion.

Figure 1:
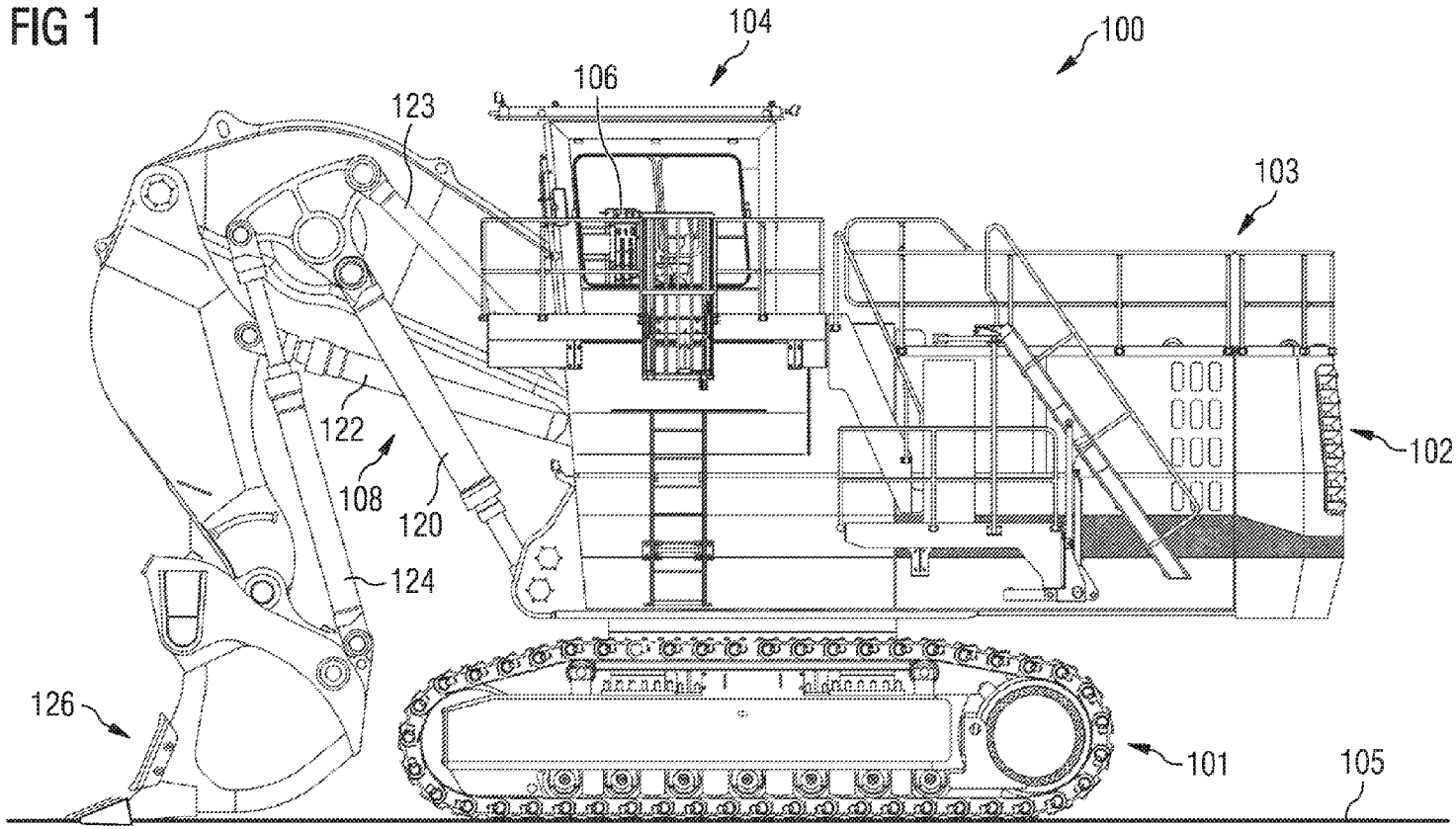
FIG. 1 illustrates an exemplary embodiment of a machine in accordance with the present disclosure.

Referring now to the drawings, an exemplary embodiment of a machine 100 is schematically shown in FIG. 1. Machine 100 may be a hydraulic excavator, for example, a large mining excavator, or any other work machine that includes an excavator bucket having a movable part. Machine 100 includes an engine 102. Engine 102 may provide power for machine 100 and its various components. Suitable engines may include gasoline powered engines, diesel powered engines, electrically powered engines or any combination of different types of engines. In one embodiment, engine 102 may be a diesel engine that generates and transfer power to other components of machine 100 through a power transfer mechanism, for example, a shaft or gearbox (not shown). Engine 102 may produce a mechanical power output that may be converted to hydraulic power, for example, by one or more pumps powered by engine 102.

Machine 100 may further include an operator station or cab 104 containing controls for operating machine 100, for example, a control panel 106. Cab 104 may be part of a superstructure 103 rotatably mounted on an undercarriage 101 of machine 100. Control panel 106 may include joysticks, levers, buttons, and the like and may be operatively connected to a hydraulic system 108 of machine 100.

In some embodiments, cab 104 may further include interfaces such as a display for conveying information to an operator, and may include a keyboard, a touch screen or any other suitable mechanism for receiving an input from an operator to control or operate machine 100, hydraulic system 108 and/or other machine components. Alternatively or additionally, an operator may be located outside of cab 104 and/or some distance away from machine 100 and may control machine 100, hydraulic system 108 and/or other machine components remotely.

Hydraulic system 108 may include fluid components such as, for example, hydraulic actuators or cylinders, tanks, valves, accumulators, orifices and other suitable components for producing a pressurized flow of hydraulic fluid. Hydraulic system 108 may further comprise fluid sources, for example, one or more tanks and/or a reservoir (not shown), and one or more hydraulic pumps, which may include variable displacement pumps, fixed displacement pumps, variable delivery pumps or other suitable pressurizing systems. The hydraulic pumps may be drivably connected to engine 102, or may be indirectly connected to engine 102 via a gear mechanism or the like. It is also contemplated that hydraulic system 108 may include multiple sources of pressurized fluid interconnected to provide hydraulic fluid for hydraulic system 108.

Hydraulic system 108 may include a plurality of hydraulic actuators, for example, one or more hydraulic actuators 120 for operating a boom of machine 100, one or more hydraulic actuators 122 for operating a stick of machine 100, one or more rods 123, one or more hydraulic actuators 124 for operating an excavator bucket 126 of machine 100, one or more hydraulic motors (not shown) for operating a swing mechanism of machine 100, and hydraulic motors associated with a left propel drive and a right propel drive of machine 100 for propelling machine 100 on a work surface 105. The swing mechanism may be operable to rotate superstructure 103 with respect to undercarriage 101 of machine 100. It should be appreciated that, in other embodiments, different numbers of hydraulic motors and/or hydraulic actuators may be provided for the different hydraulic circuits.

Machine 100 also includes a control unit (not shown) suitable for controlling hydraulic system 108 and other components of machine 100. The control unit may be operatively connected to an input device (not shown) and may be adapted to receive an input from an operator indicative of a desired movement (or a desired velocity) of machine 100 or an implement of machine 100, for example, excavator bucket 126, and thus may determine a power demand associated with each hydraulic actuator or motor of hydraulic system 108 for performing the desired movements.

The control unit may include one or more control modules (for example, ECMs, ECUs, etc.). The one or more control modules may include processing units, a memory, sensor interfaces and/or control interfaces for receiving and transmitting signals. The processing units may represent one or more logic and/or processing components used by the system according to the present disclosure to perform various communications, control and/or diagnostic functions. The one or more control modules may communicate to each other and to other components within and interfacing the control unit using any appropriate communication mechanisms, for example, a CAN bus.

Further, the processing units may be adapted to execute instructions, for example, from a storage device such as a memory. The one or more control modules may each be responsible for executing software code for hydraulic system 108 and/or other components of machine 100. The processing units may include, for example, one or more general purpose processing units and/or special purpose units (for example, ASICs, FPGAs, etc.). In some embodiments, the functionality of the processing units may be embodied in an integrated microprocessor or microcontroller, including an integrated CPU, a memory, and one or more peripherals.

Figure 2B:
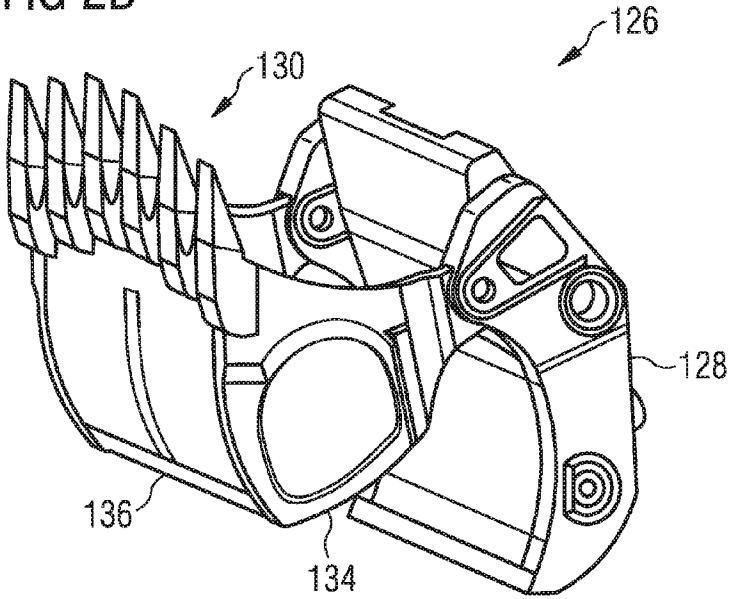
FIGS. 2A and 2B show an exemplary embodiment of an excavator bucket with a movable part in a first position and a second position, respectively, in accordance with the present disclosure.
Figure 2A:
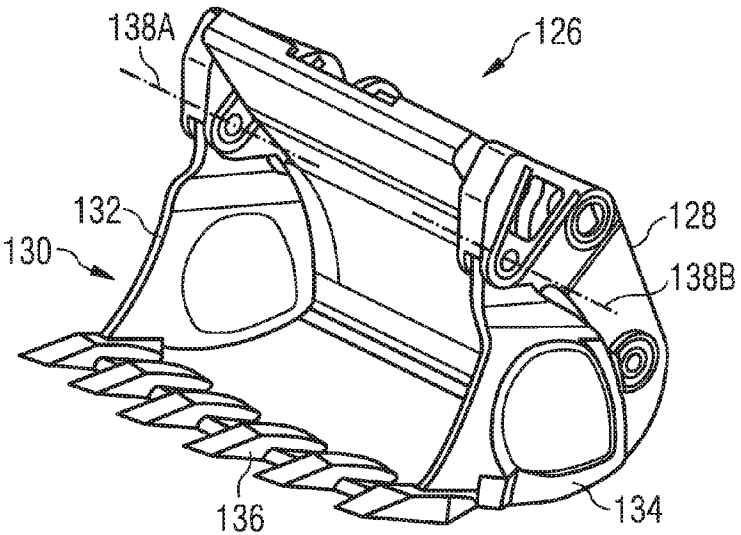

Referring now to FIGS. 2A and 2B, an exemplary embodiment of an excavator bucket 126 according to the present disclosure will be described in more detail.

As shown in FIGS. 2A and 2B, excavator bucket 126 includes a rear wall 128 and a movable part 130, for example, a movable front part. Rear wall 128 is pivotably connected to the stick of machine 100 (see FIG. 1), and may be pivoted by expanding or retracting hydraulic actuator 124. Movable part 130 is pivotably attached to rear wall 126 via pins 138A, 138B, which are schematically illustrated in FIG. 2A by dashed lines. It should be appreciated that, in other embodiments, movable part 130 may be attached to rear wall 128 with a different configuration.

Movable part 130 includes a first side wall 132, a second side wall 134 and a bottom 136. First and second side walls 132, 134 are pivotably connected to rear wall 138 via pins 138A, 138B, respectively. Further, first and second side walls 132 and 134 may be connected to bottom 136, for example, by welding or in any other suitable manner to form movable part 130 of excavator bucket 126.

One or more hydraulic actuators (not shown) may be mounted on rear wall 128 of excavator bucket 126 and engage with engagement portions of side walls 132, 134, as will be described in more detail below. Upon actuation of the hydraulic actuators connected to side walls 132, 134, movable part 130 may be tilted upwards to open excavator bucket 126, as shown in FIG. 2B. In this manner, material in excavator bucket 126 may be released, for example, into a truck bed of a dump truck or the like.

As shown in FIGS. 2A and 2B, side walls 132, 134 include a cranked portion to extend outward from rear wall 128 for the above-described reasons.

Figure 3B:
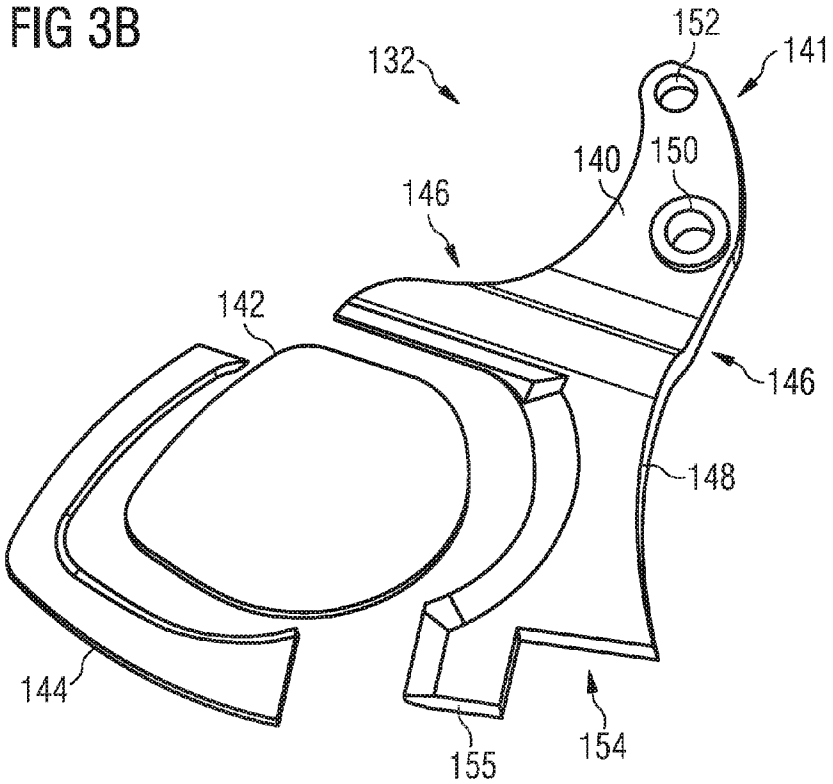
FIGS. 3A and 3B show a perspective view and an exploded perspective view, respectively, of an exemplary embodiment of a side wall for a movable part of an excavator bucket in accordance with the present disclosure.
Figure 3A:
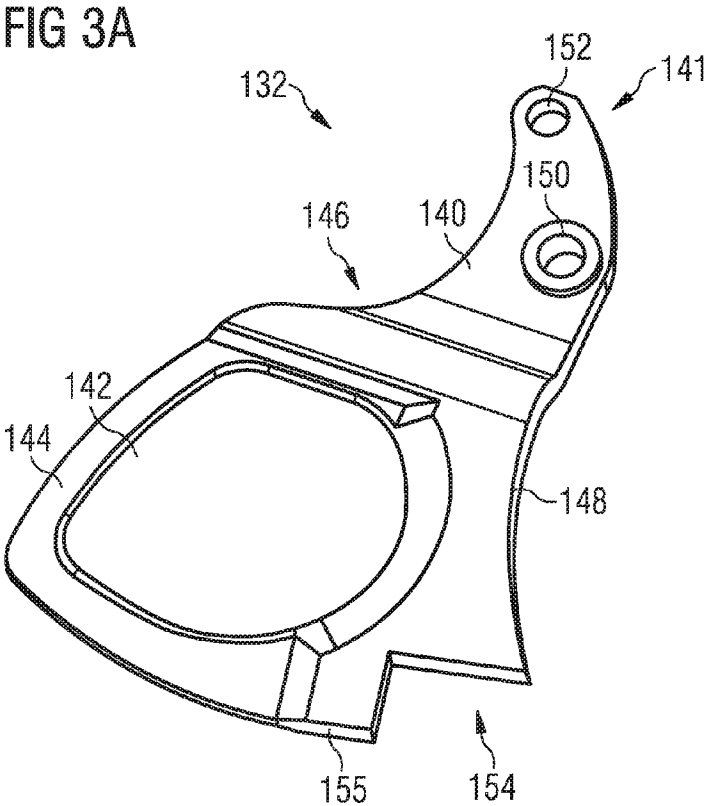

Referring now to FIGS. 3A and 3B, exemplary side wall 132 is described in more detail. It should be appreciated that side wall 134 may have the same configuration as side wall 132, except for cranked portion 146 described below, which will be bent in the opposite direction.

As shown in FIG. 3A, side wall 132 includes a one-piece sheet metal base 140 and one or more sheet metal members 142, 144 connected to sheet metal base 140 to form side wall 132. In the exemplary embodiment shown in FIGS. 3A and 3B, two sheet metal members 142, 144 are connected to sheet metal base 140. However, it will be appreciated that in other embodiments in accordance with the present disclosure more than two sheet metal members or only a single sheet metal member may be connected to sheet metal base 140. In some embodiments, no additional sheet metal members may be present, and side wall 132 may be formed by sheet metal base 140 only.

Sheet metal base 140 includes an attachment portion 141, a cranked portion 146, and an extension portion 154.

Attachment portion 141 may be formed as a substantially flat portion and may be configured to be attached to rear wall 128 of excavator bucket 126. In the exemplary embodiment shown in FIGS. 3A and 3B, attachment portion 141 includes a first hole 150 for receiving pin 138A (see FIG. 2A), and a second hole 152 for engagement with the associated hydraulic actuator. While it has previously been described that the associated hydraulic actuator is mounted on rear wall 128, it is also contemplated that the associated hydraulic actuator may mounted on other components of machine 100, for example, the stick of machine 100.

Cranked portion 146 extends from attachment portion 141 towards a distal end 155 of sheet metal base 140, with a width that is gradually increasing towards distal end 155. In addition, cranked portion 146 is bent such that it extends further outwards than attachment portion 141 when it is attached to rear wall 128. It will be readily appreciated that cranked portion 146 includes a first portion 146a that is bent in a first direction d1 with respect to a direction of extension of attachment portion 141, and a second portion 146b that is bent into an opposite second direction d2 (see FIG. 4*a*).

Extension portion 154 extends from second portion 146b of cranked portion 146 to distal end 155 of sheet metal base 140, as shown in FIG. 3B. In the exemplary embodiment, extension portion 154 extends to the distal end of side wall 132 which, in the exemplary embodiment shown in FIGS. 3A and 3B, is the same as distal end 155 of sheet metal base 140. It should be appreciated, however, that in other embodiments, extension portion 154 may not extend over the full length of side wall 132, such that the distal end of side wall 132 will be formed by one of sheet metal members 142, 144.

As shown in FIGS. 3A and 3B, sheet metal base 140 further includes a front edge 148 extending from attachment portion 141 to distal end 155 of sheet metal base 140, wherein front edge 148 at least partially forms a front edge of excavator bucket 126 (see, for example, FIGS. 2A and 2B).

Figure 4B:
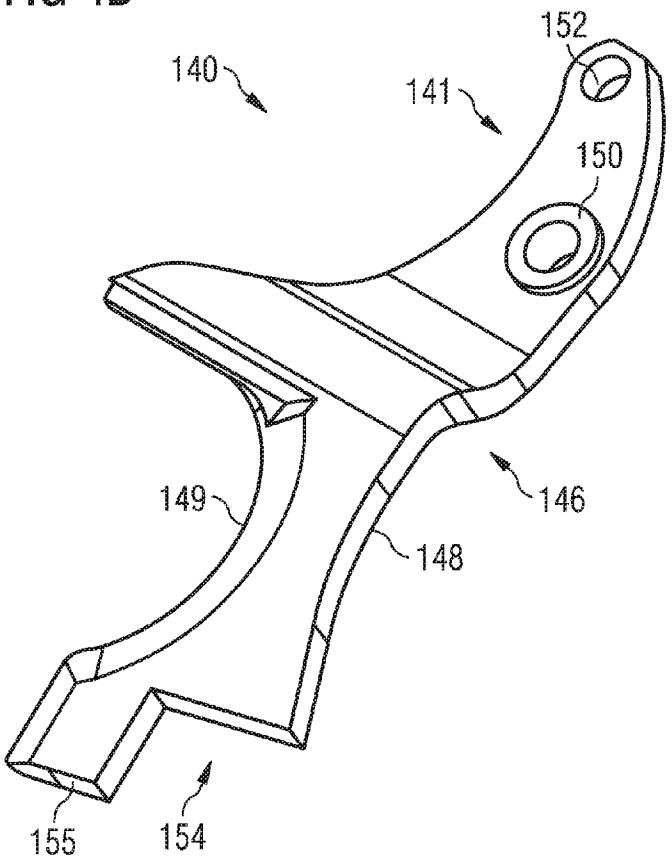
FIGS. 4A and 4B show a front view and a perspective view, respectively, of an exemplary embodiment of a sheet metal base in accordance with the present disclosure.
Figure 4A:
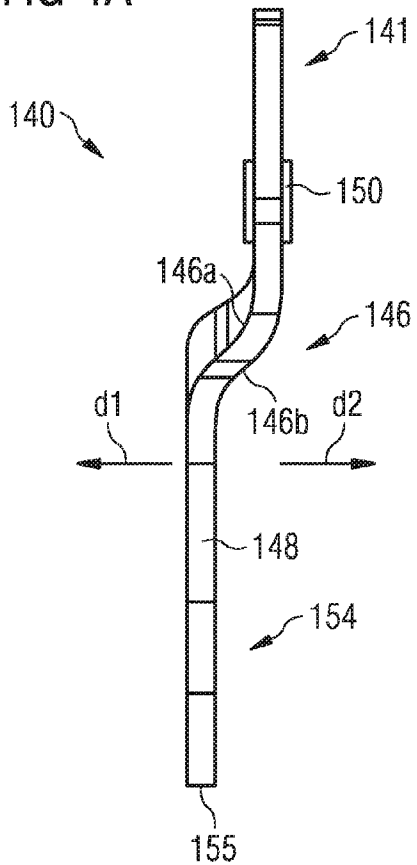

Turning now to FIGS. 4A and 4B, sheet metal base 140 of side wall 132 is shown in more detail.

FIG. 4A shows a front view of sheet metal base 140, and FIG. 4B shows a perspective view of sheet metal base 140. It can be clearly seen in FIG. 4A that cranked portion 146 results in that attachment portion 141 and extension portion 154, which both are formed as substantially flat portions, are offset with respect to each other by the width of cranked portion 146 in the direction perpendicular to the direction of extension of attachment portion 141 and extension portion 154. It should be appreciated that, in other exemplary embodiments, attachment portion 141 and extension portion 154 do not need to be parallel to each other. Further, in other embodiments, attachment portion 141 and extension portion 154 do not need to be formed as flat portions, and may include one or more curved portions, steps, or the like.

In accordance with exemplary embodiments of the present disclosure, sheet metal base 140 may have a length of between around 1500 and around 4500 mm, and a width of between around 500 and around 2500 mm. Cranked portion 146 may be formed such that it has a length in the direction of extension of sheet metal base 140 that is between, for example, ⅛ and ⅓, preferably ⅙ and ¼, of the length of sheet metal base 140. Accordingly, cranked portion 146 may extend over a length from between around 150 to around 1500 mm. Further, cranked portion 146 may be formed to have a width in the transversal direction of sheet metal base 140 from between around 250 to around 1500 mm. An angle between first portion 146*a* and attachment portion 141 may be between around 20 and around 45 degrees, and an angle between second portion 146*a* and extension portion 154 may be between around 20 and around 45 degrees. Of course, the configuration of cranked portion 146 may be determined individually for different excavator buckets.

Sheet metal base 140 may further be formed from a flat sheet metal part having a thickness of between 30 and 250 mm, depending on the size of excavator bucket 126. It will be appreciated that the surface of sheet metal base 140 may be machined to result in desired properties of sheet metal base 140, for example, front edge 148. Machining steps may include flame cutting, plasma cutting or laser cutting, grinding to provide a good edge surface quality, and removal of material by means of grinding, milling or drilling. In addition, heat treatment and/or flame straightening may be applied to sheet metal base 140.

As previously described, sheet metal members 142, 144 may be connected to sheet metal base 140 by welding. However, it will be readily appreciated that sheet metal members 142, 144 may be connected to sheet metal base 140 by other means, for example, using bolts or the like.

INDUSTRIAL APPLICABILITY

The industrial applicability of the systems and methods disclosed herein will be readily appreciated from the foregoing discussion. One exemplary machine suited to the disclosure is an excavator such as a large mining excavator. Similarly, the systems and methods described can be adapted to a large variety of machines and tasks.

In accordance with some exemplary embodiments, a method of forming a side wall of a movable part of an excavator bucket may comprise providing a flat sheet metal base and bending the flat sheet metal base to form an attachment portion for attaching the side wall to a rear wall of the excavator bucket, a cranked portion extending from the attachment portion towards a distal end of the sheet metal base, and an extension portion extending from the cranked portion to the distal end of the sheet metal base.

Sheet metal base 140 may be formed from any appropriate material, such as metals, alloys or the like. Typical thicknesses of sheet metal base 140 may range from between around 30 to around 250 mm. Sheet metal base 140 may be bent into shape to result in cranked portion 146 having desired dimensions using any known technique, for example, by flame cutting, plasma cutting or laser cutting, then bending, and then again cutting. Grinding may be needed to ensure good edge quality. Material may be removed by means of grinding, milling or drilling after bending. Heat treatment may be applied before and/or after bending. Flame straightening may be required after bending to keep dimensional and/or geometrical tolerances.

The exemplary method of forming the side wall may further comprise welding one or more sheet metal members to sheet metal base 140 to form side wall 132 and/or side wall 134. As mentioned above, alternatively one or more sheet metal members 142, 144 may be attached to sheet metal base 140 using appropriate fastening elements. For example, if bolts are used to attach sheet metal members 142, 144 to sheet metal base 140, corresponding through holes may be formed in sheet metal base 140.

In addition, the exemplary method may further comprise forming holes 150, 152 for receiving pin 138A and engaging with a hydraulic actuator for pivoting movable part 130, respectively. Hole 150 and/or hole 152 may include a hub (not shown) for distributing loads, which may be welded in the corresponding hole and may be formed of one or more parts. In addition, various edges of sheet metal base 140 may be machined to facilitate welding of sheet metal members 142, 144 to sheet metal base 140, and to result in the desired durability of front edge 148 of sheet metal base 140 during operation of machine 100. For example, grinding of weld seams may be needed to ensure a smooth transition and a good surface quality.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of disclosure more generally. All methods described herein may perform in any suitable order unless otherwise indicated herein or clearly contradicted by context.

Accordingly, this disclosure includes all modifications and equivalences of the subject-matter recited in the claims appended hereto as permitted by applicable law. Moreover, any combination of the above-described elements in all possible variations thereof is encompassed by the disclosure unless otherwise indicated herein or clearly contradicted by context.

Although the preferred embodiments of this disclosure have been described herein, improvements and modifications may be incorporated without departing from the scope of the following claims.

The invention claimed is:

1. A side wall of a movable part of an excavator bucket, the side wall comprising:

a sheet metal base including an attachment portion for attaching the side wall to a rear wall of the excavator bucket, a cranked portion extending from the attachment portion, and an extension portion extending from the cranked portion to a distal end of the sheet metal base along a longitudinal direction of the side wall, wherein the cranked portion includes a bend that extends along a transverse direction, the transverse direction being transverse to the longitudinal direction, and wherein a length of the cranked portion along the longitudinal direction is between ⅛ to ⅓ of an overall length of the sheet metal base along the longitudinal direction.

2. The side wall of claim 1, further comprising at least one sheet metal member connected to the sheet metal base to form the side wall.

3. The side wall of claim 2, wherein the at least one sheet metal member is welded to the sheet metal base.

4. The side wall of claim 2, wherein sheet metal member is connected to the sheet metal base by at least one fastening element.

5. The side wall of claim 4, wherein the at least one fastening element is a screw.

6. The side wall of claim 1, further including an edge extending from the attachment portion to the distal end of the sheet metal base, wherein the edge forms at least part of a front edge of the excavator bucket.

7. The side wall of claim 1, wherein the attachment portion is offset from the extension portion by a width of the cranked portion along a thickness direction of the side wall, the thickness direction being perpendicular to the transverse direction.

8. The side wall of claim 1, wherein the side wall is configured to be pivotably attached to the rear wall via the attachment portion, and the sheet metal base further includes an actuator engagement portion configured to engage with an actuator such that the actuator is capable of pivoting the side wall with respect to the rear wall.

9. The side wall of claim 1, wherein the sheet metal base has a thickness between around 30 mm to around 250 mm.

10. The side wall of claim 1, wherein the attachment portion is formed as a substantially flat portion, and the cranked portion is formed such that, when the side wall is attached to the rear wall, the extension portion is offset from the rear wall.

11. A movable part of an excavator bucket; the movable part comprising:

a first side wall including a sheet metal base, the sheet metal base including an attachment portion for attaching the first side wall to a rear wall of the excavator bucket, a cranked portion extending from the attachment portion, and an extension portion extending from the cranked portion to a distal end of the sheet metal base along a longitudinal direction of the first side wall;

a second side wall; and a bottom connected to the first side wall and the second side wall, such that the first side wall faces the second side wall across the bottom, wherein the cranked portion includes a bend that extends along a transverse direction, the transverse direction being transverse to the longitudinal direction, and wherein a length of the cranked portion along the longitudinal direction is between ⅛ to ⅓ of an overall length of the sheet metal base along the longitudinal direction.

12. The movable part of claim 11, further including at least one sheet metal member connected to the sheet metal base to form the first side wall.

13. The movable part of claim 12, wherein the at least one sheet metal member is welded to the sheet metal base.

14. The movable part of claim 12, wherein the at least one sheet metal member is connected to the sheet metal base by at least one fastening element.

15. The movable part of claim 11, wherein the first side wall is configured to be pivotably attached to the rear wall via the attachment portion, and the sheet metal base further includes an actuator engagement portion configured to engage with an actuator such that the actuator is capable of pivoting the first side wall with respect to the rear wall.

16. The movable part of claim 11, wherein the attachment portion is formed as a substantially flat portion, and the cranked portion is formed such that the extension portion is offset from the rear wall.

17. A method for making a movable part of an excavator bucket, the method comprising:

providing a first side wall including a sheet metal base, the sheet metal base including an attachment portion for attaching the first side wall to a rear wall of the excavator bucket, a cranked portion extending from the attachment portion, and an extension portion extending from the cranked portion to a distal end of the sheet metal base along a longitudinal direction of the first side wall;

providing a second side wall; and connecting a bottom of the movable part to the first side wall and the second side wall, such that the first side wall faces the second side wall across the bottom, wherein the providing the first side wall includes forming the cranked portion by bending the sheet metal base to form a bend in the sheet metal base along a transverse direction, the transverse direction being transverse to the longitudinal direction, and wherein a length of the cranked portion along the longitudinal direction is between ⅛ to ⅓ of an overall length of the sheet metal base along the longitudinal direction.

18. The method of claim 17, wherein the providing the first side wall further includes connecting at least one sheet metal member to the sheet metal base.

19. The method of claim 18, wherein the connecting the at least one sheet metal member to the sheet metal base includes welding the at least one sheet metal member to the sheet metal base.

20. The method of claim 18, wherein the connecting the at least one sheet metal member to the sheet metal base includes fastening at least one fastening element through the at least one sheet metal member and the sheet metal base.

* * * * *